US010745036B2

(12) United States Patent
Zhang et al.

(10) Patent No.: US 10,745,036 B2
(45) Date of Patent: Aug. 18, 2020

(54) BOGIE

(71) Applicant: CRRC TANGSHAN CO., LTD., Tangshan (CN)

(72) Inventors: Xiaojun Zhang, Tangshan (CN); Junfeng Wang, Tangshan (CN); Na Lu, Tangshan (CN); Lijun Zhang, Tangshan (CN); Wenhao Hu, Tangshan (CN)

(73) Assignee: CRRC TANGSHAN CO., LTD., Tangshan (CN)

( * ) Notice: Subject to any disclaimer, the term of this patent is extended or adjusted under 35 U.S.C. 154(b) by 0 days.

(21) Appl. No.: 16/231,085

(22) Filed: Dec. 21, 2018

(65) Prior Publication Data

US 2019/0118840 A1 Apr. 25, 2019

Related U.S. Application Data

(63) Continuation of application No. PCT/CN2016/102659, filed on Oct. 20, 2016.

(30) Foreign Application Priority Data

Jun. 21, 2016 (CN) ..... 2016 1 0450924

(51) Int. Cl.
*B61F 5/52* (2006.01)
*B61F 5/04* (2006.01)
*B61F 5/30* (2006.01)

(52) U.S. Cl.
CPC ..... *B61F 5/52* (2013.01); *B61F 5/04* (2013.01); *B61F 5/30* (2013.01)

(58) Field of Classification Search
CPC ..... B61F 5/30; B61F 5/04; B61F 5/52
See application file for complete search history.

(56) References Cited

U.S. PATENT DOCUMENTS 3,376,831 A * 4/1968 Eaton ..... B61C 9/50 105/197.05
3,455,252 A * 7/1969 Lich ..... B61F 5/24 105/199.2

(Continued)

FOREIGN PATENT DOCUMENTS

CN 201249778 Y 6/2009
CN 102530005 A 7/2012

(Continued)

OTHER PUBLICATIONS

The International Search Report of corresponding International PCT Application No. PCT/CN2016/102659, dated Mar. 14, 2017.

(Continued)

*Primary Examiner* — Jason C Smith
(74) *Attorney, Agent, or Firm* — J.C. Patents

(57) ABSTRACT

A bogie, including a frame (1) and a bolster (2), the frame (1) including two parallel side beams (11), and a cross beam (12) coupled to the middle of the side beams (11), wherein a primary suspension is arranged between an end of the side beam (11) and an axle box (31), a secondary suspension is arranged between the below of the bolster (2) and the cross beam (12), and a tertiary suspension coupled to a vehicle body is arranged above the bolster (2). By including a bolster and an extra suspension on the basis of the conventional two suspensions, the disclosed bogie can achieve separation of the functions, so that the tertiary suspension only handles the transverse displacement, and the secondary suspension only handles the rotation, thereby further increasing the relative displacement and rotation angle between the vehicle body and the bogie when the vehicle negotiates a curve.

18 Claims, 20 Drawing Sheets

(56) References Cited

U.S. PATENT DOCUMENTS

| | | | | |
|---|---|---|---|---|
| 3,602,149 | A * | 8/1971 | Lich | B60L 13/035 104/291 |
| 3,628,465 | A * | 12/1971 | Dobson | B61F 5/142 105/191 |
| 3,807,313 | A * | 4/1974 | Koyanagi | B60L 13/035 104/291 |
| 3,818,841 | A * | 6/1974 | Julien | B61F 1/14 105/164 |
| 3,988,992 | A * | 11/1976 | Schindehutte | B60B 9/12 105/199.3 |
| 4,046,080 | A * | 9/1977 | Dieling | B61D 13/00 105/133 |
| 5,081,934 | A * | 1/1992 | De Ro | B61D 11/00 105/168 |
| 6,247,413 | B1 * | 6/2001 | Teichmann | B61F 5/22 105/199.1 |
| 8,356,557 | B2 * | 1/2013 | Schneider | B61F 5/24 105/199.2 |
| 10,011,287 | B2 * | 7/2018 | Ma | B60T 7/124 |
| 2005/0183625 | A1 * | 8/2005 | Goding | B61F 3/06 105/182.1 |
| 2013/0019774 | A1 * | 1/2013 | Ahuja | B61C 9/50 105/133 |
| 2017/0232979 | A1 * | 8/2017 | Zhang | B61F 5/52 105/198.1 |
| 2019/0118840 | A1 * | 4/2019 | Zhang | B61F 5/52 |

FOREIGN PATENT DOCUMENTS

| | | | |
|---|---|---|---|
| CN | 203372249 | U | 1/2014 |
| CN | 103770803 | A | 5/2014 |
| CN | 205168526 | U | 4/2016 |
| CN | 106004913 | A | 10/2016 |
| CN | 205819216 | U | 12/2016 |
| DE | 2001282 | A | 7/1970 |
| EP | 393177 | A1 | 10/1990 |
| EP | 397291 | A2 | 11/1990 |
| FR | 2102922 | A5 | 4/1972 |
| JP | 2002-046602 | A | 2/2002 |
| KR | 2006-0077437 | A | 7/2006 |
| KR | 2006-0077438 | | 7/2006 |
| KR | 2006-0077438 | A | 7/2006 |

OTHER PUBLICATIONS

The Chinese First Examination Report of corresponding China patent application No. 201610450924.0, dated Oct. 19, 2017.
The Chinese Second Examination Report of corresponding China patent application No. 201610450924.0, dated Jul. 2, 2018.
European Search Report for PCT/CN2016102659.

* cited by examiner

BOGIE

CROSS-REFERENCE TO RELATED APPLICATIONS

This application is a continuation of International Application No. PCT/CN2016/102659, filed on Oct. 20, 2016, which claims priority to Chinese Patent Application No. 201610450924.0, filed on Jun. 21, 2016. The disclosures of the aforementioned applications are hereby incorporated by reference in their entireties.

TECHNICAL FIELD

The present disclosure relates to the technical field of high-speed rolling stock bogie and, in particular, to a bogie using three suspensions.

BACKGROUND

A bogie, as an important component of a rolling stock, is used to bear a vehicle, provide traction, vibration attenuation and steering. A power bogie is also used to provide power to drive the rolling stock.

A bogie can be classified into a bogie with a bolster and a bogie without a bolster. A bogie in the prior art generally includes several major components such as a frame, a wheelset, an axle box, etc., in which the axle box is coupled to the frame through a primary suspension, and the frame is coupled to the vehicle body by a secondary suspension. A suspension apparatus generally includes an elastic support component (e.g., a spring) and a vibration attenuating component (e.g., a hydraulic damper) for absorbing energy. FIG. 23 is a schematic structural diagram of a CRH3 series bogie in the prior art, where the frame includes two side beams 101, two cross beams 102 and two longitudinal beams 103 being welded together to form an "H" box structure, the side beam 101 is a steel plate being welded together to form a sunken "U" structure, with the sunken portion of the side beam 101 being provided with an air spring 104 that serves as a support component for the secondary suspension and is coupled to the vehicle body.

A drawback in the prior art is that, during a curve movement, the vehicle relies solely on the displacement of the air spring to achieve rotation and traverse displacement between the vehicle body and the bogie, allowing only a small deflection between the two, preventing the vehicle from making small radius turns. Therefore, the safe operation of the vehicle using such bogie requires a large turning radius for the rail, incurring extra construction difficulty and cost to works on complex terrain.

SUMMARY

In view of the above defects of the prior art, the issue to be solved in the present disclosure is providing a bogie to increase the amount of displacement and rotation angle between the vehicle body and the bogie, so as to improve the capacity for the vehicle in terms of curve negotiating and adaptability to route condition.

In order to solve the above issue, a bogie is provided, including a frame and a bolster, where the frame includes two parallel side beams and a cross beam coupled to the middle of the side beams. The improvement lies in that: a primary suspension is arranged between an end of the side beam and an axle box, a secondary suspension is arranged between the below of the bolster and the cross beam, and a tertiary suspension coupled to a vehicle body is arranged above the bolster.

Preferably, the frame formed as an "H".

Preferably, a middle portion of the side beam is sunken to form a sunken portion for mounting the bolster.

Preferably, a middle portion of the cross beam is provided with a traction pin hole, a middle portion of an underside of the bolster is provided with a traction pin, and the bolster is coupled to the cross beam through the traction pin. Further, the traction pin is provided with an elastic pin bush.

Preferably, the tertiary suspension includes any one or a combination of a plurality of laminated rubber pads, air springs or spiral steel springs.

Preferably, the secondary suspension includes any one or a combination of a plurality of laminated rubber pads, air springs or spiral steel springs. In order to mounting the second suspension, the upper surface of the cross beam is provided with a plurality of mounting seats for mounting the secondary suspension.

In one embodiment, the secondary suspension includes four laminated rubber-metal pads, which are uniformly and symmetrically distributed between the below of the bolster and the cross beam. Correspondingly, an upper surface of the cross beam is provided with four mounting seats for mounting the secondary suspension.

Preferably, a middle portion of one side of the bolster is provided with a transverse damper, which is formed with an opening, with two opposing stop sides being provided with a buffer rubber, respectively.

Further, another side of the bolster is provided with two transverse dampers opposed to each other, one end of the transverse damper is coupled to the bolster, and the other end is coupled to the bottom of the vehicle body.

Preferably, both ends of the bolster are provided with two vertical dampers, respectively.

The bogie of the present disclosure also includes a "Z" traction rod, and a first mounting seat provided separately on both ends of the bolster, where a rubber joint is provided separately both ends of the traction rod, and one end of the traction rod is arranged on the first mounting seat while another end is coupled to the vehicle body.

Further, the bogie of the present disclosure also includes an anti-yaw damper, which is provided on one end at the first mounting seat, and coupled on another end to the side beam of the frame.

Preferably, the elastic pin bush is a laminated rubber-metal structure.

Preferably, a center pin hole is provided at the middle of an upper side of the bolster for receiving a rigid stop pin arrange at the center of a bolster beam of the vehicle body.

The bogie of the present disclosure further includes a foundation brake apparatus which in turn includes a tread brake unit and a disc brake unit, both ends of each of the side beams are provided with a disc brake mounting seat for mounting the disc brake unit, and the inner side of the sunken portion of each side beam is provided with a tread brake mounting seat for mounting the tread brake unite.

When the bogie of the present disclosure is used as a power bogie, the front and rear sides of the cross beam are provided with a motor hanger and a gear box hanger, which are both box structures formed by welding, forging or casting.

The disclosed bogie is provided with a bolster, and on the basis of the original two suspensions, another suspension is added beneath of the bolster and between the bolster and the cross beam to achieve the separation of the functions, so that the tertiary suspension above the bolster only functions to handle the transverse displacement, and the secondary suspension beneath the bolster only functions to handle the rotation, thereby further increasing, when the vehicle negotiates a curve, the relative rotation angle between the vehicle body and the bogie, improving curve negotiating for the vehicle. By combining three suspensions, the disclosed bogie can also perform well in vibration isolation and noise reduction, effectively attenuating the vibration from interactions between the wheel and the rail, improve riding comfort.

DETAILED DESCRIPTION OF THE EMBODIMENTS

The present disclosure is described in further detail with reference to, rather than being limited by, the accompanying drawings and specific embodiments.

Embodiment 1

Figure 1:
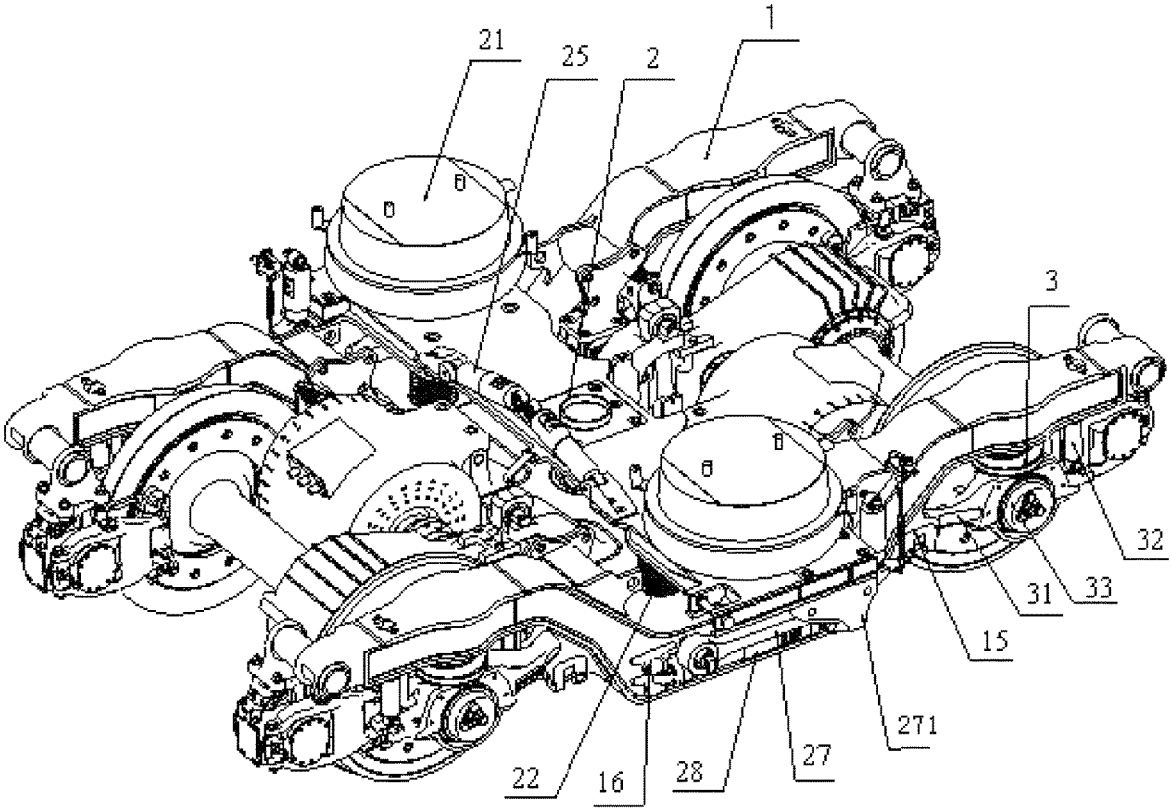
FIG. 1 is a schematic perspective view of a bogie in Embodiment 1 of the present disclosure.
Figure 2:
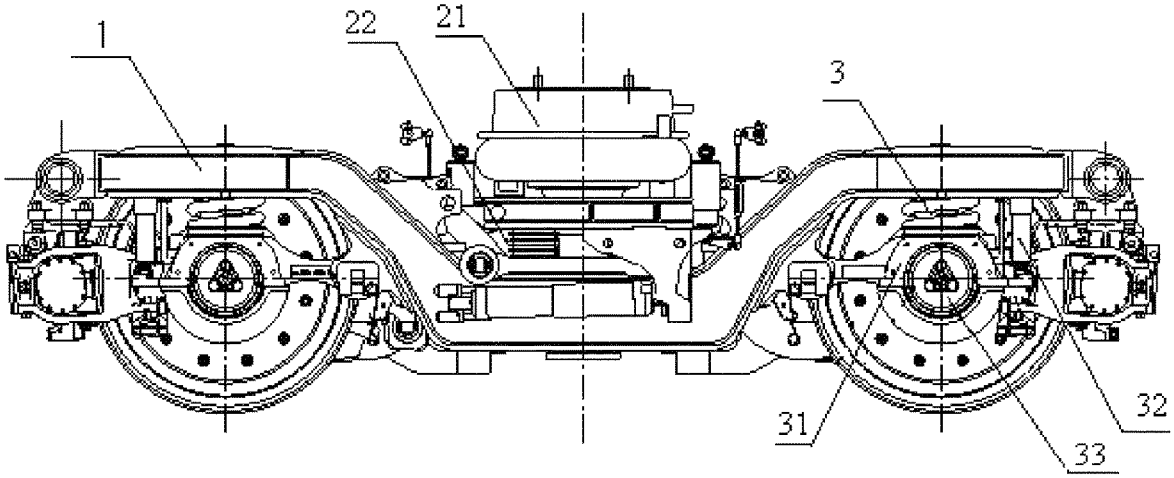
FIG. 2 is a primary view of FIG. 1 (viewed laterally from the propelling direction)
Figure 3:
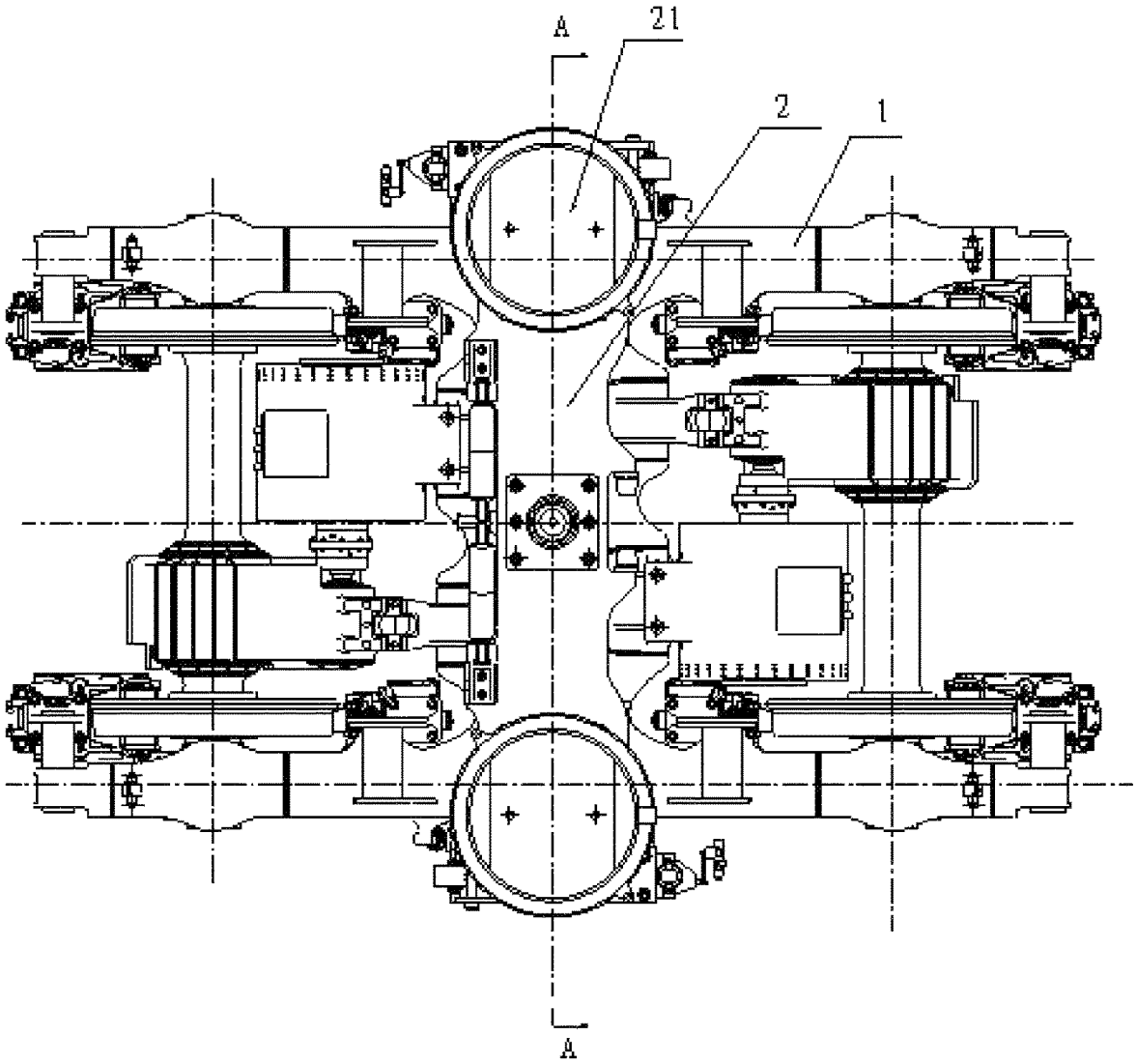
FIG. 3 is a top view of FIG. 1.
Figure 4:
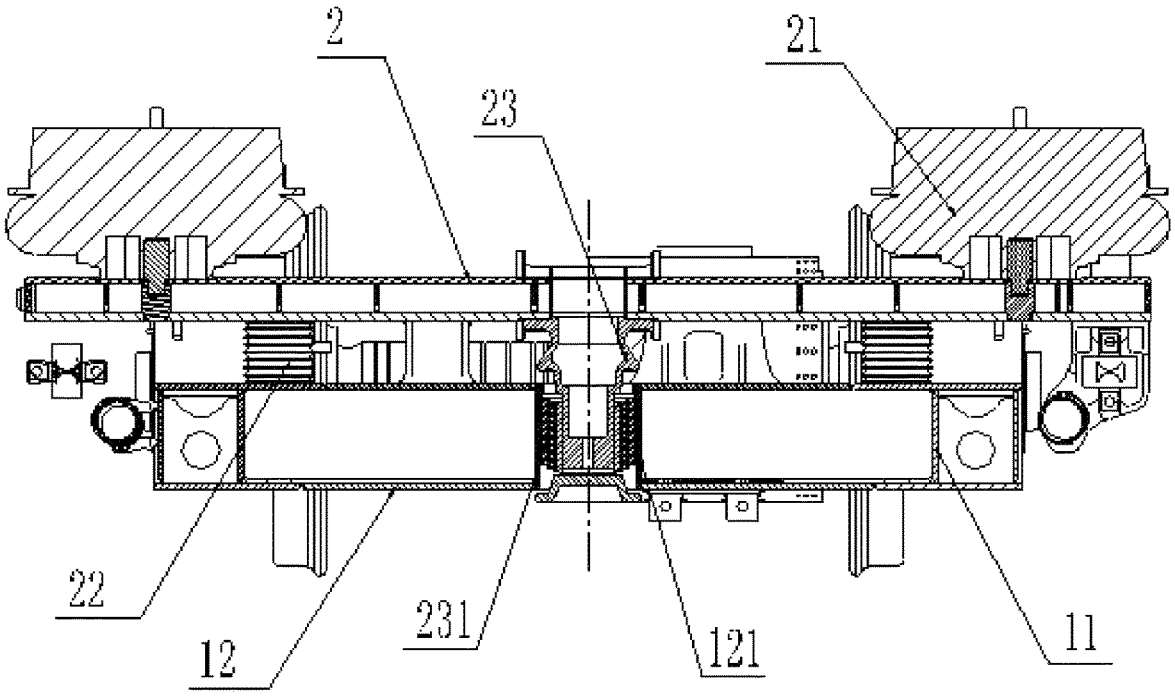
FIG. 4 is a cross-sectional view taken along the line A-A in FIG. 3.
Figure 5:
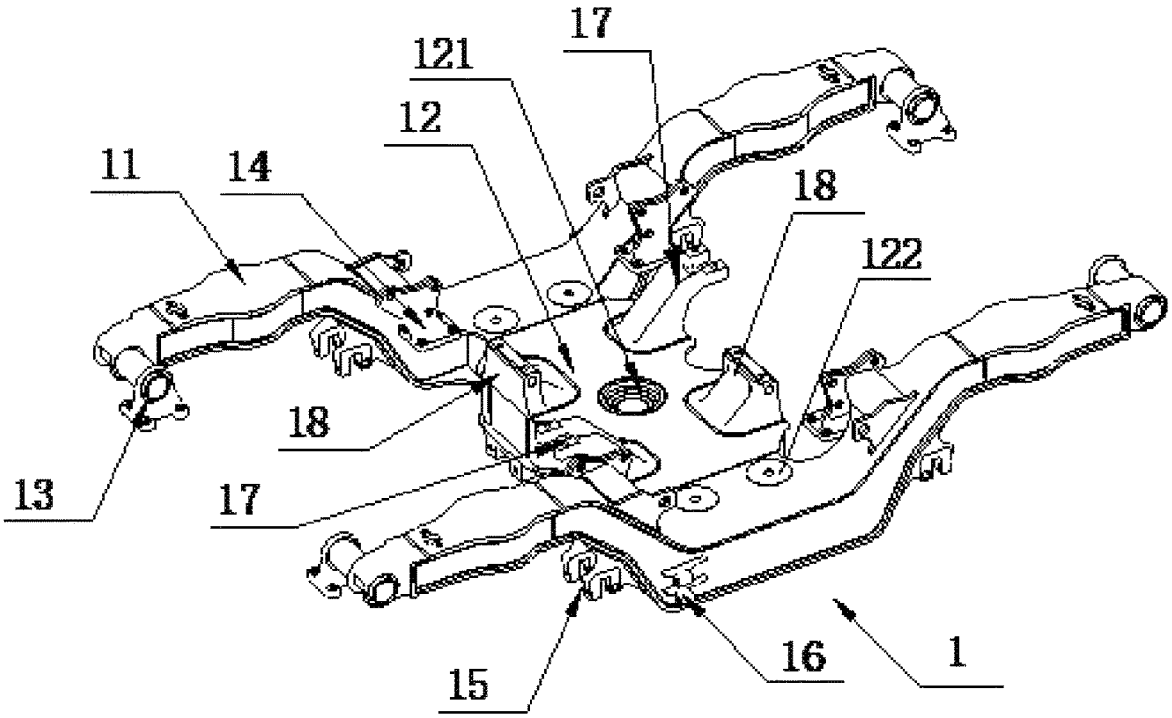
FIG. 5 is a schematic perspective view of a frame in Embodiment 1.
Figure 6:
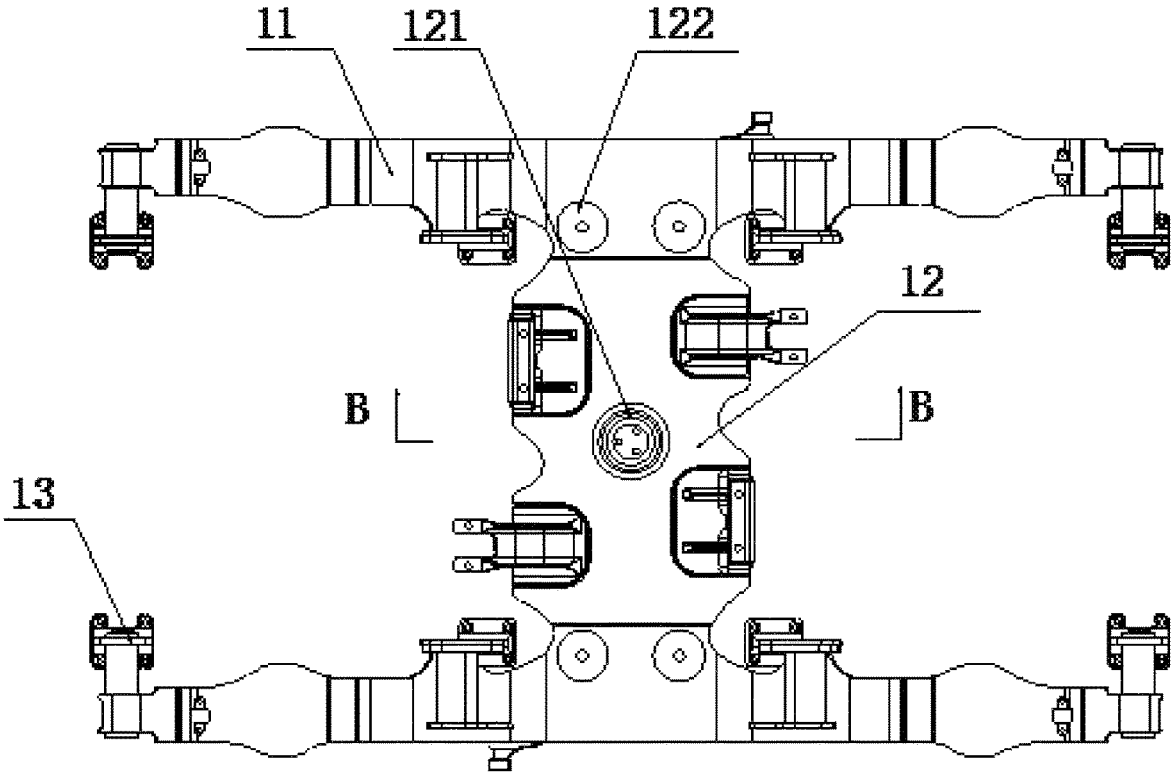
FIG. 6 is a top view of the frame shown in FIG. 5.
Figure 7:
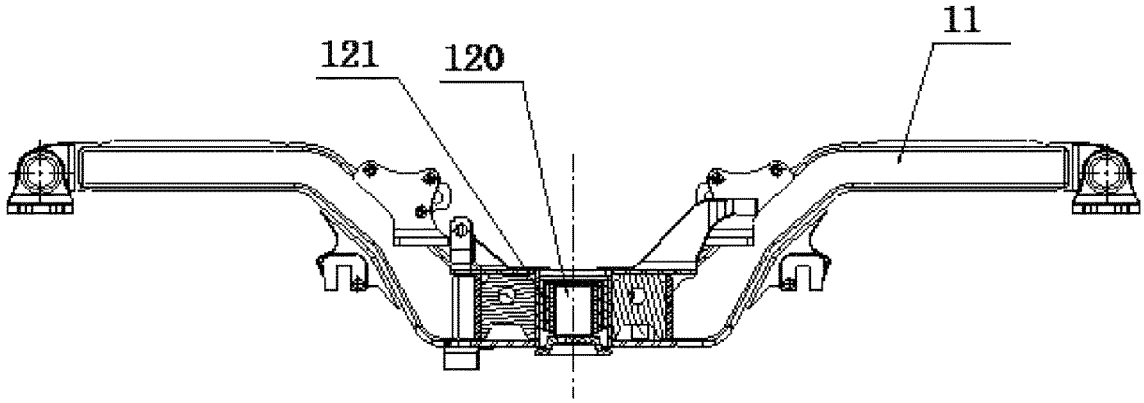
FIG. 7 is a cross-sectional view taken along the line B-B in FIG. 6.
Figure 8:
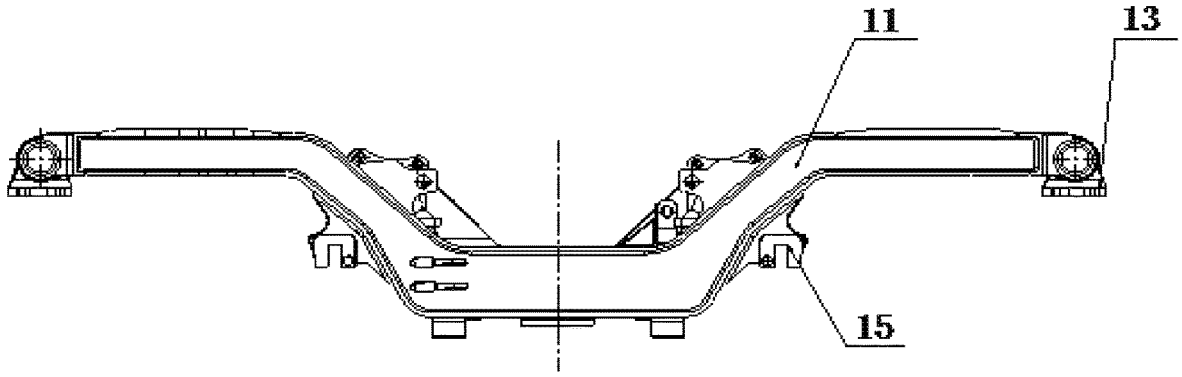
FIG. 8 is a primary view of the frame shown in FIG. 5 (viewed laterally from the propelling direction)
Figure 9:
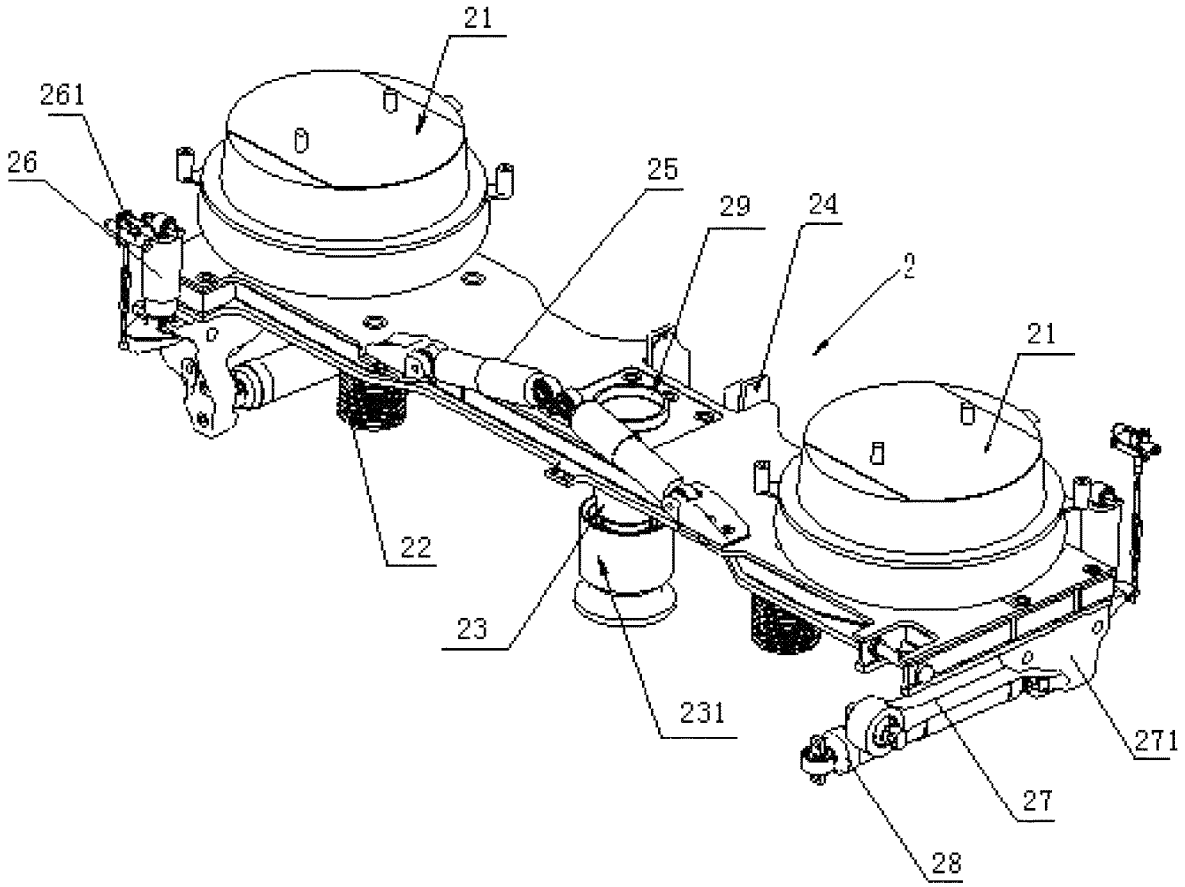
FIG. 9 is a schematic perspective view of a bolster of the bogie in Embodiment 1.
Figure 10:
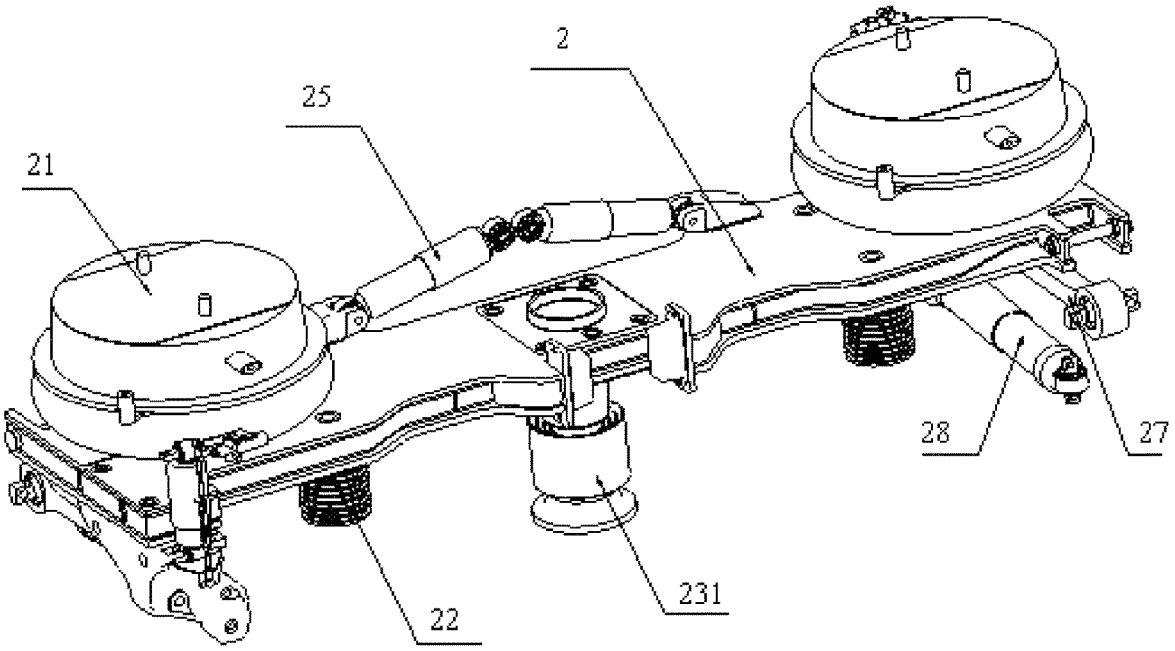
FIG. 10 is a schematic perspective view taken from another direction of FIG. 9.
Figure 11:
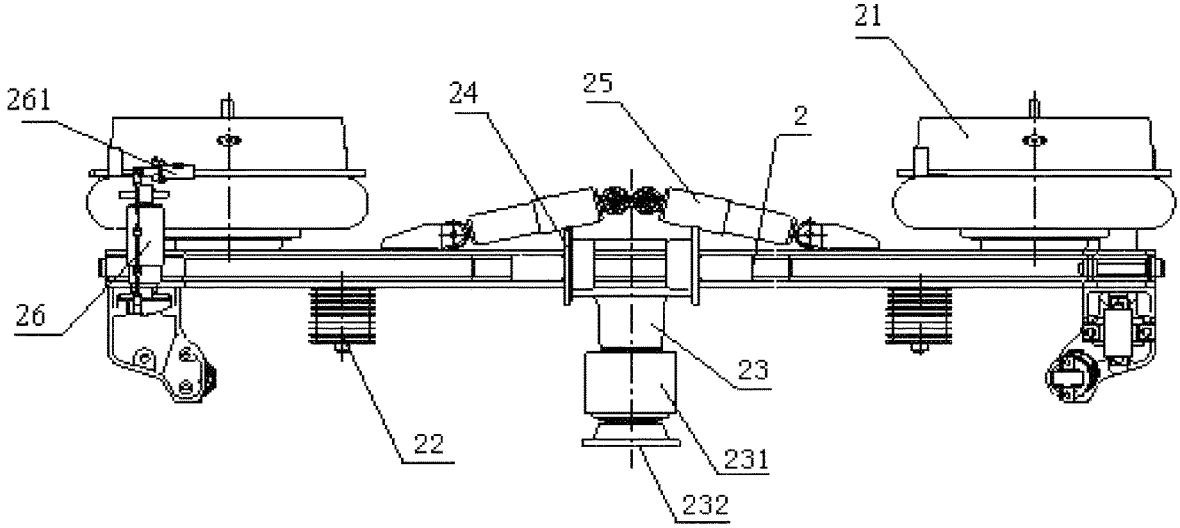
FIG. 11 is a primary view of FIG. 9.
Figure 12:
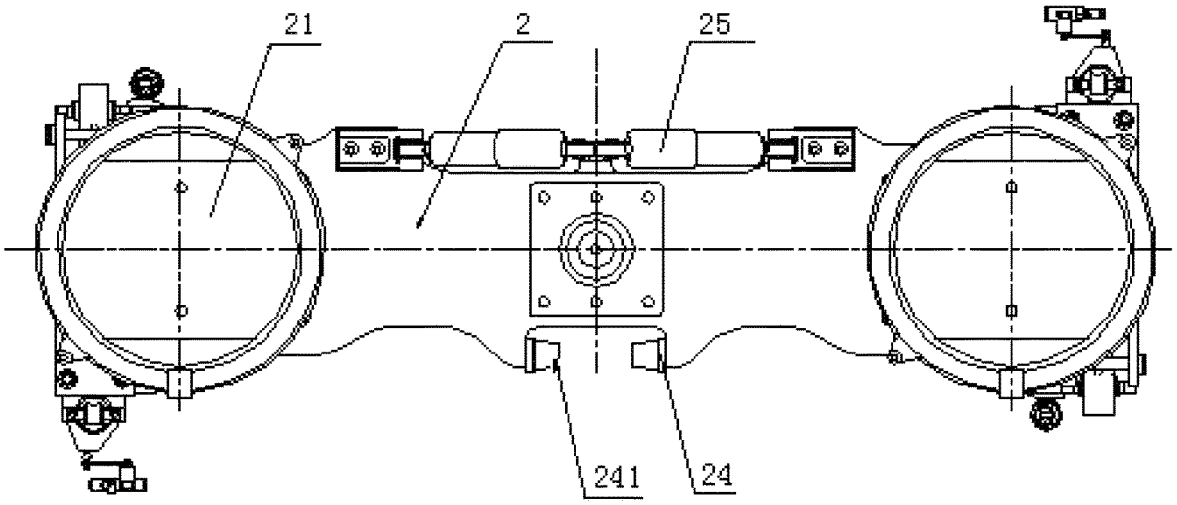
FIG. 12 is a top view of FIG. 11.
Figure 13:
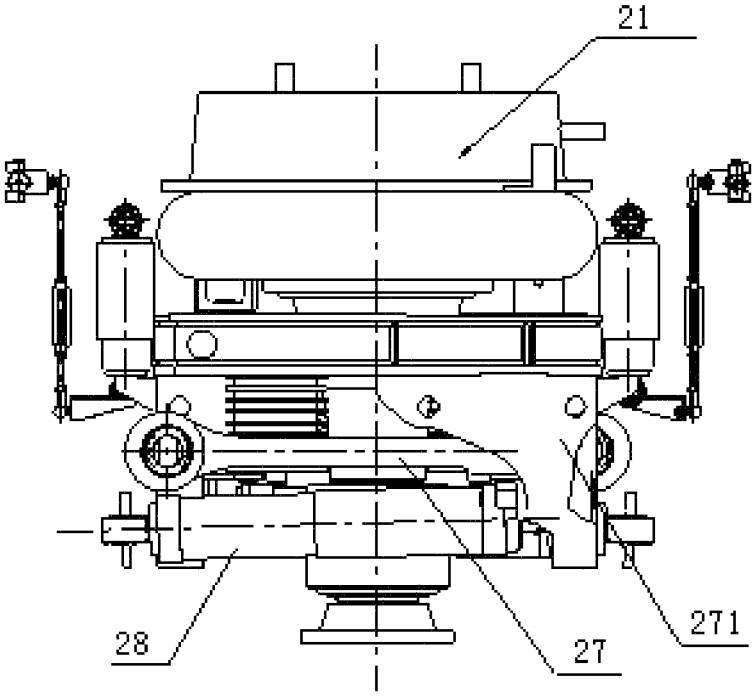
FIG. 13 is a left view of FIG. 11.

FIG. 1 is a schematic perspective view of a bogie in Embodiment 1 of the present disclosure; FIG. 2 is a primary view of FIG. 1 (viewed laterally from the propelling direction); and FIG. 3 is a top view of FIG. 1; FIG. 4 is a cross-sectional view taken along the line A-A in FIG. 3. FIG. 5 is a schematic perspective view of a frame in Embodiment 1; FIG. 6 is a top view of the frame shown in FIG. 5; FIG. 7 is a cross-sectional view taken along the line B-B in FIG. 6; and FIG. 8 is a primary view of the frame shown in FIG. 5 (viewed laterally from the propelling direction). FIG. 9 is a schematic perspective view of a bolster of the bogie in Embodiment 1; FIG. 10 is a schematic perspective view taken from another direction of FIG. 9; FIG. 11 is a primary view of FIG. 9; FIG. 12 is a top view of FIG. 11; and FIG. 13 is a left view of FIG. 11.

As shown in FIGS. 1 to 4, and with reference to FIGS. 5 to 13, the bogie of the Embodiment 1 of the present disclosure includes a frame 1 and a bolster 2. As shown in FIGS. 5 to 8, in the present embodiment, the frame 1 is formed as an "H", including two parallel side beams 11 and a cross beam 12 that is coupled to the middle of the side beams 11, where the middle of the side beam 11 is sunken into a "U", forming a sunken portion for mounting the bolster 2. A primary suspension is arranged between each of the two ends of the side beam 11 and a rotary arm axle box 31; a secondary suspension is arranged beneath the bolster 2 and between the bolster 2 and the cross beam 12, and a tertiary suspension coupled to a vehicle body is arranged above the bolster 2. In the present embodiment, the primary suspension includes an axle box spring 3 and a primary vertical damper 32, which are provided between the rotary arm axle box 31 and the frame 1. The axle box spring 3 is a double scroll spiral steel spring placed atop the rotary arm axle box 31, and the upper half of the spring component extends into the spring seat in the side beam 11 of the frame 1. A rubber pad is provided between the bottom of the spring 3 and the top of the rotary arm axle box 31 for absorbing the impact and high-frequency vibration from the rail. The primary vertical damper 32 functions to reduce the vibration from the rail, which is a common design that will not be elaborated any further. The present disclosure is characterized in that the vehicle body and the frame are coupled via two suspensions, which are the secondary suspension provided beneath the bolster 2 and between the bolster 2 and the cross beam 12, and the tertiary suspension above the bolster 2 and coupled to the vehicle body. By separating the functions, i.e., the secondary suspension used exclusively for the rotation function while the tertiary suspension for the transverse displacement function, it is possible to further improve the amount of allowable transverse freeplay and relative rotation angle between the vehicle body and the bogie when the vehicle is negotiating a curve, improving curve negotiating for the vehicle. The secondary suspension is fixedly provided on the lower surface of the bolster 2 and coupled to the cross beam 12. Correspondingly, the upper surface of the cross beam 12 of the frame 1 is provided with a plurality of mounting positions 122 for mounting the secondary suspension.

As shown in FIGS. 1 to 4, in the present embodiment, the tertiary suspension uses a first air spring 21 as a support component, where the first air spring 21 ensures that the vehicle remains at a constant height. A height adjustment valve 261 is arranged beside the first air spring 21. The vehicle body is supported by four air springs on the front and rear bogies. In addition to supporting the load of the vehicle body, the air springs can also isolate the vibration from the bogie frame, as well as shift positions in order to realize transverse movement between the vehicle and the bogie while passing through a curved segment. The first air spring 21 is a common component in the art, which will not be elaborated any further. However, the support component for the tertiary suspension is not limited to the first air spring 21, but can be replaced by a laminated rubber pad, a spiral steel spring or any combination thereof.

In the present embodiment, the secondary suspension includes a plurality of first laminated rubber pads 22, which can also be replaced by an air spring or a spiral steel spring, or any combination of the laminated rubber pad, air spring and spiral steel spring, and these alternative solutions are specifically described in the following embodiments. The laminated rubber pad in the secondary suspension of the present embodiment is used to receive forces from various directions, and then attenuate a part of the vibrations through the vibration attenuation characteristic of the rubber, functioning as the suspension. The main function of the secondary suspension is to undertake the rotation function between the vehicle body and the bogie when the vehicle passes through a curve. The laminated rubber pad can provide maximum vertical rigidity and minimal horizontal rigidity through the metal plate and the rubber layer-by-layer structure, and reduce the rigidity for the rotation between the frame 1 and the bolster 2, facilitating the bogie when passing through the curve. Meanwhile, the maximum vertical rigidity will provide sufficient roll rigidity for the bogie, so that the flexibility factor of the bogie meets the overall requirement of the bogie. In order to avoid the instability on the laminated rubber pad during an excessive horizontal displacement, subject to the requirements of side roll performance, the transversal span is minimized for the laminated rubber pad. When the vehicle passes through a curve, due to the large radial deformation of the laminated rubber pad, the bolster 2 (and the body coupled thereto) has a large rotational movement relative to the frame 1, improving curve negotiating for the vehicle.

In the present embodiment, in order to transmit the longitudinal load between the vehicle body and the bogie, a traction rod 27 with a "Z" arrangement is arranged between the vehicle body and the bolster, and a traction pin 23 is arranged between the bolster 2 and the frame 1. As shown in FIGS. 5 to 7, the middle portion of the cross beam 12 of the frame 1 is provided with a traction pin hole 120. Correspondingly, as shown in FIGS. 9 to 11, the middle portion of the underside of the bolster 2 is provided with the traction pin 23, and the bolster 2 is coupled to the cross beam 12 through the traction pin 23, and an elastic pin bush 23 is cupped over the traction pin 231. The elastic pin bush 231 is a laminated rubber-metal structure. As a preferred solution, the traction pin hole 120 is provided with an elastic pin hole bush 121, which can also use a laminated rubber-metal structure. In this way, a pin joint is formed between the traction pin 23 and the traction pin hole 120, achieving a design objective of eliminating lubrication point on the bogie, while fulfilling the need for small rotational rigidity, small vertical rigidity (or axial rigidity), maximum longitudinal rigidity and transverse rigidity (or radial rigidity), reducing the effect of rotation between the bogie frame 1 and the bolster 2, as well as providing longitudinal and transversal load transfer. The "Z" traction rod is formed into a "Z" when seen in the top view, and includes two traction rods 27 at both ends of the bolster 2, respectively. In order to receive the traction rod 27, as shown in FIGS. 9 and 13, both ends of the bolster 2 are provided with a first mounting seat 271, and both ends of the traction rod 27 are provided with a rubber joint, where one end of the traction rod 27 is arranged on the first mounting seat 271, and the other end of the traction rod 27 is coupled to the vehicle body (not shown) through the rubber joint. In this way, the transfer sequence of the longitudinal force (traction or brake force) is: (the wheel grips the rail) wheel→axle→rotary arm axle box→positioning rotary arm seat→frame→traction pin (tertiary suspension)→bolster→traction rod→traction rod seat→vehicle body→vehicle coupler.

As shown in FIGS. 9 and 12, the middle portion of one side of the bolster 2 is provided with a transverse damper 24, which is formed with an opening, with two opposing stop sides being provided with a buffer rubber 241, respectively. A stopper (not shown) coupled to the vehicle body is located in the opening of the transverse buffer 24 and remains a set distance from the two stop sides. The transverse buffer 24 functions to limit excessive transverse displacement from happening between the vehicle body and the bogie. When the transverse displacement between the vehicle body and the bogie exceeds the set distance, the stopper coupled to the vehicle body contacts with the buffer rubber 241 on the stop side of the transverse buffer 24, thus resulting a reverse compressive force to limit the transverse displacement thereof. The buffer rubber exhibits non-linearity, such that its rigidity increases the deflection increases. When the vehicle body is subjected to only a small transversal force, the limiting and buffering can be provided by the transverse buffer 24.

In addition, referring to FIG. 9, the middle of the upper side of the bolster 2 is provided with a center pin hole 29 for receiving a rigid stop pin (not shown) provided at the center of the bolster beam of the vehicle body. The rigid stop pin is provided at the center of, and welded onto, the vehicle body bolster beam, and is inserted into the center pin hole 29 in the center of the bolster 2 of the bogie. When the vehicle is in normal operation, the two will always maintain a certain gap in the longitudinal and vertical direction without contact. When the vehicle is subject to a large longitudinal force (such as two vehicles colliding), the middle of the rigid stop pin of the vehicle body bolster beam contacts with the center pin hole 29 on the bolster 2, preventing the separation of the vehicle from the bogie. When the vehicle is subject to a large transversal force, the rigid stop pin will contact with the center pin hole 29 after the buffer rubber 241 of the transverse buffer 24 is elastically compressed, thus limiting the excessive transverse displacement of the vehicle body. The strength of the stop structure should be that the structure does not break when subject to an impact force of 250,000 pound (113397.5 kg) in the event of a vehicle collision or a derailment, etc.

For the purpose of vibration attenuation, a damper for multiple directions is usually set in the suspension system. For example, as shown in FIGS. 9 to 12, one side of the bolster 2 is provided with two opposing transversal dampers 25, where one end of the transversal damper 25 is coupled to the bolster 2, and the other end is coupled to the bottom of the vehicle body (not shown), functioning to attenuate the transversal vibration between the vehicle body and the bogie. The transversal damper 25 and the transverse buffer 24 described above are located on opposite sides of the bolster 2.

At the same time, in order to further reduce the vibration in the vertical direction, the two ends of the bolster 2 are separately provided with a secondary vertical damper 26, which is provided beside the first air spring 21. The two opposing vertical dampers are skew symmetrically arranged at both ends of the bolster 2 in a vertical direction to attenuate the vertical vibration between the vehicle body and the bogie. In addition, in the first air spring 21, an orifice is arranged between an airbag and an additional air chamber, such that the flow of the air between the two chambers through the orifice can also attenuate the vertical vibration between the vehicle body and the bogie.

As shown in FIGS. 9 and 13, the bogie of the present embodiment further includes an anti-yaw damper 28, one end of which is arranged on the first mounting seat 271 and the other end is coupled to the side beam 11 of the frame 1. The anti-yaw damper 28 is arranged between the bolster 2 and the frame 1 to prevent the hunting instability from happening to a train during high-speed operation. The structure of the anti-yaw damper 28 is a common component in the design of a high-speed train, which will not be elaborated any further.

The bogie of the present embodiment further includes a foundation brake apparatus which in turn includes a tread brake unit and a disc brake unit. As shown in FIG. 5, both ends of each beam 11 are provided with a disc brake mounting seat 13 for mounting the disc brake unit, and the inner side of a sunken portion of each side beam 11 is provided with a tread brake mounting seat 14 for mounting the tread brake unite. The tread brake unit and the disc brake unit are common brake units in the art, and in the present embodiment, the mounting positions thereof are set depending on the structure of the frame 1. In addition, since the disc brake unit and the tread brake unit are used in combination, the tread brake apparatus can be used to improve the gripping between the wheel and the rail while reducing operating noise.

When the bogie is a power bogie, as shown in FIG. 5, the front and rear sides of the cross beam 12 are both provided with a motor hanger 18 and a gear box hanger 17, both of which are welded box structures with the advantages of high strength and light weight. In order to reduce the weight, the motor hanger 18 and the gear box hanger 17 of the present embodiment are welded structures. In practice, the motor hanger 18 and the gear box hanger 17 may also be structured using forging or casting.

In view of its structure, the bolster 2 is used as the load bearing component for transmitting loads in the secondary suspension and the tertiary suspension, and is embedded with mounting interfaces of various components. In terms of the prior art, the bolster has three structural modes, which are steel plate welding, integral cast steel structure and integral cast aluminum structure. As a preferred solution, in the present embodiment, the bolster 2 is structured as a steel plate welded box and an inner rib is provided inside, after the bolster 2 is successfully welded, an integral annealing process and an integral machining are conducted to form a box shaped structure with a hollow inside, as shown in FIG. 4.

As shown in FIG. 5, the frame 1 is used as a base for mounting other components. In order to fit into the sunken structure of the side beam 11, the front and rear sides of the sunken portion of each side beam 11 are provided with a positioning rotary arm seat 15 for mounting the rotary arm that in turn retains the axle box in position. The outside of the side beam 11 is provided with an anti-yaw damper seat 16 for mounting the anti-yaw damper. Referring to FIG. 1, an anti-yaw damper 27 is coupled on one end to an anti-yaw damper mounting seat 16 on the side beam 11, and another end to the first mounting seat 271 on the bolster.

For the consideration of weight-reducing, in the present embodiment, the side beam 11 is a closed box welded by a steel plate, including a lower cover plate and an upper cover plate formed by integral stamping, where a stand plate is provided inside. The end of the side beam 11 is welded by a steel pipe and a forging/casting piece. The cross beam 12 is also a box structure welded by the steel plate. In the cross-sectional view shown in FIG. 4, the side beam 11 and the cross beam 12 are hollow structures.

Now the primary suspension in the present embodiment will be described further in the following. As shown in FIG. 1, in the present embodiment, the axle box positioning apparatus of the primary suspension employs a rotary arm elastic positioning mode, which is a proven approach. In this mode, the rotary arm axle box 31 is coupled on one end to a bearing 33 of a wheelset assembly, and another end to a positioning rotary arm seat 15 provided on the front or the rear side of the sunken portion of each side beam 11. The elastic node of the rotary arm axle box 31 is a movable joint joining the wheelset and the frame. In addition to transmitting the force and vibration from various directions, the axle box must ensure that the wheelset can adapt to the rail line condition and move vertically and transversely with respect to the frame. The rotary arm axle box 31 is a proven technique employed in the primary suspension, and will not be elaborated any further.

Now, other implementations of the bogie of the present disclosure will be illustrated in the following with reference to the accompanying drawings. In the following embodiments, structures similar to those in the Embodiment 1 will not be repeated.

Embodiment 2

Figure 14:
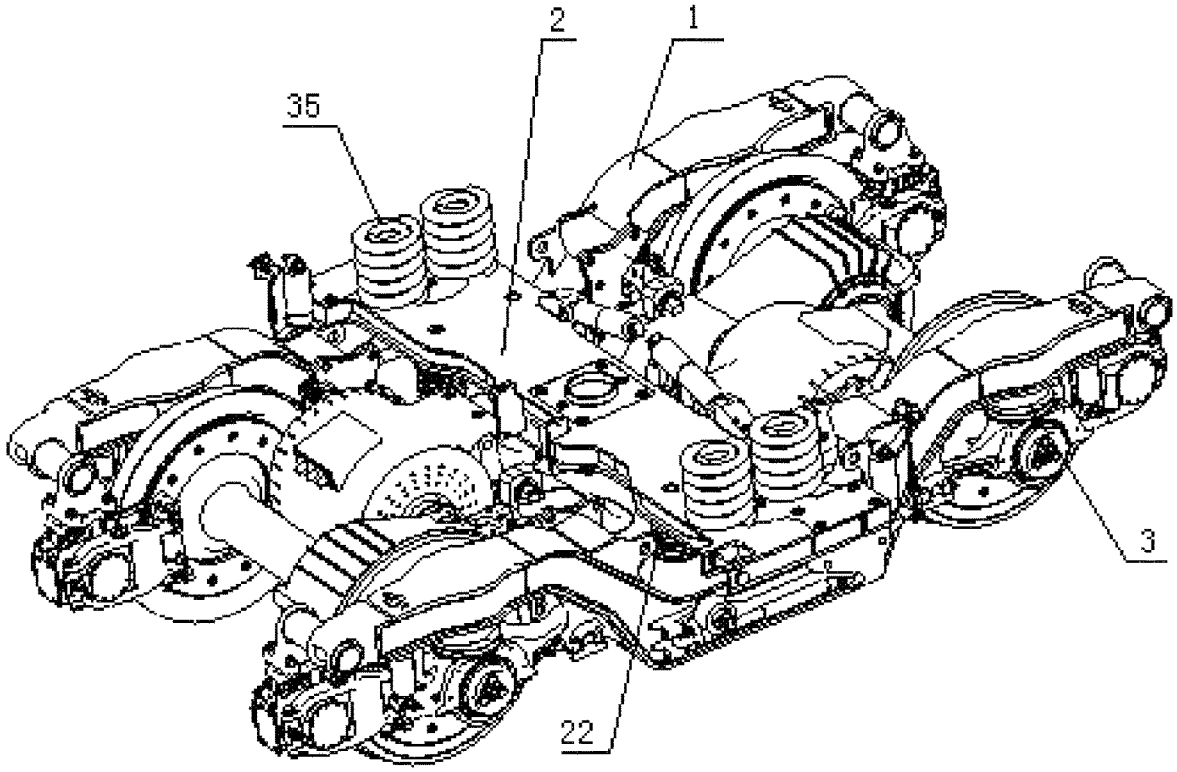
FIG. 14 is a schematic perspective view of a bogie in Embodiment 2 of the present disclosure.

FIG. 14 is a schematic perspective view of a bogie in Embodiment 2 of the present disclosure. In the Embodiment 2 shown in FIG. 14, the difference from the Embodiment 1 is that the tertiary suspension employs a first spiral steel a spring 35 to replace the first air spring 21 of the Embodiment 1 shown in FIG. 1. Obviously, there are multiple first spiral steel springs 35 distributed symmetrically at both ends of a bolster 2, and in the embodiment shown in FIG. 14, two first spiral steel springs 35 are arranged atop the bolster 2 on left and right ends thereof, respectively.

Embodiment 3

Figure 15:
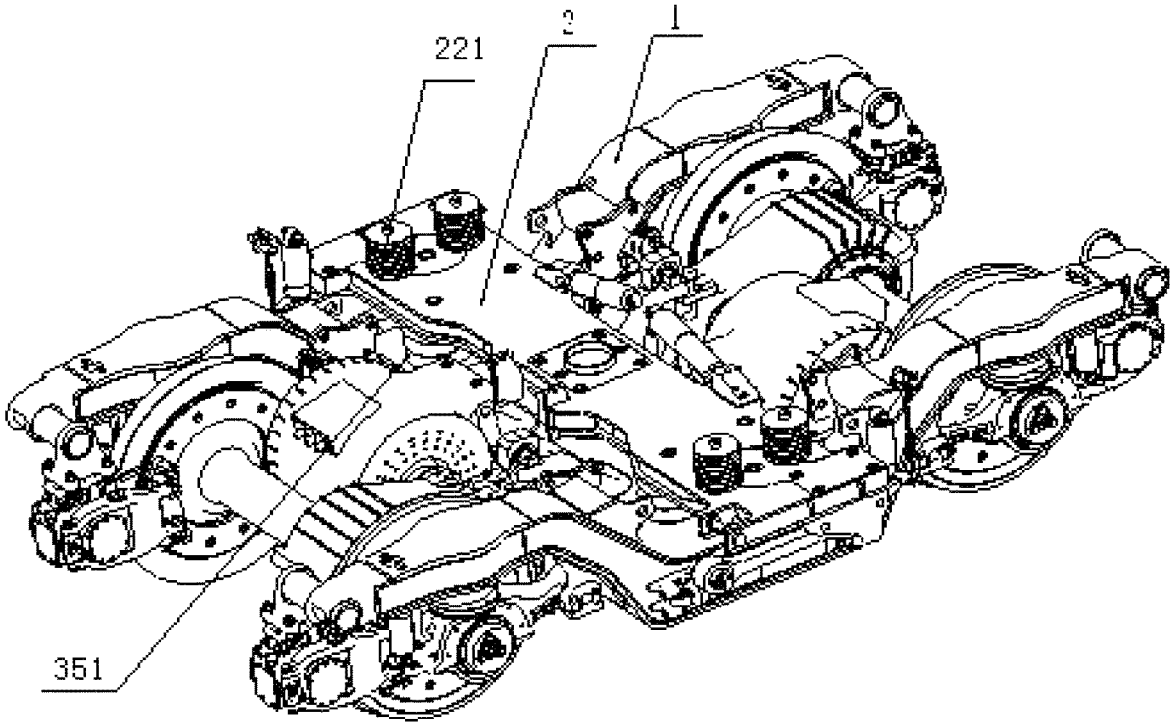
FIG. 15 is a schematic perspective view of a bogie in Embodiment 3 of the present disclosure.
Figure 16:
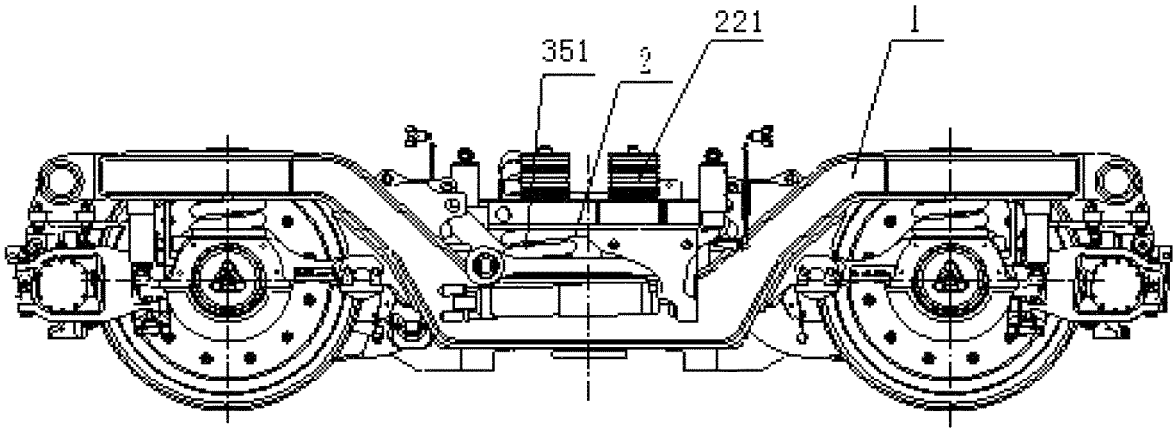
FIG. 16 is a primary view of FIG. 15 (viewed laterally from the propelling direction)

FIG. 15 is a schematic perspective view of a bogie in Embodiment 3 of the present disclosure; and FIG. 16 is a primary view of FIG. 15 (viewed laterally from the propelling direction). The difference from Embodiment 1 is that the structures of the secondary suspension and the tertiary suspension of the Embodiment 3 are both different. As shown in FIGS. 15 and 16, in the Embodiment 3, the tertiary suspension employs a plurality of second laminated rubber pads 221, the secondary suspension employs a plurality of second spiral steel springs 351. The second laminated rubber pads 221 and the second spiral steel springs 351 all come in plurality, and are arranged symmetrically on both ends of the bolster 2. In the embodiment shown in FIGS. 15 and 16, two second laminated rubber pads 221 are arranged in parallel above the left and right ends of the bolster 2, respectively. Two second spiral steel springs 351 are arranged in parallel on the left and right ends below the bolster 2, respectively.

Embodiment 4

Figure 17:
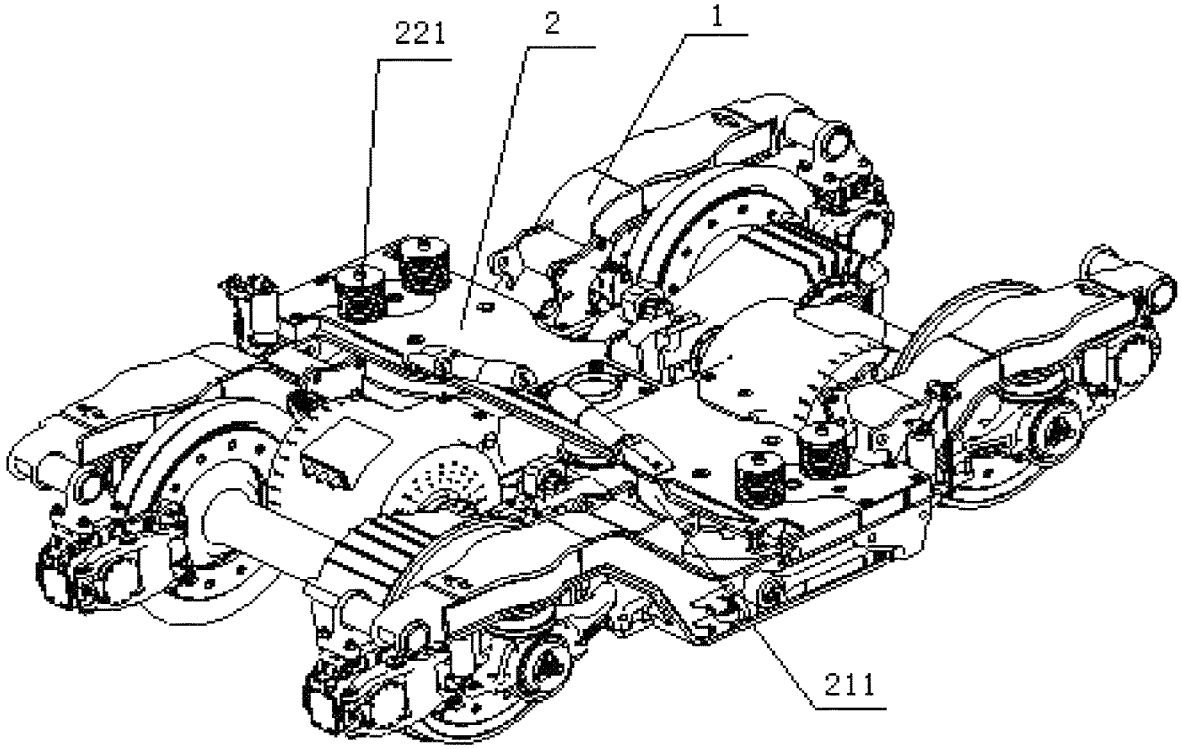
FIG. 17 is a schematic perspective view of a bogie in Embodiment 4 of the present disclosure.
Figure 18:
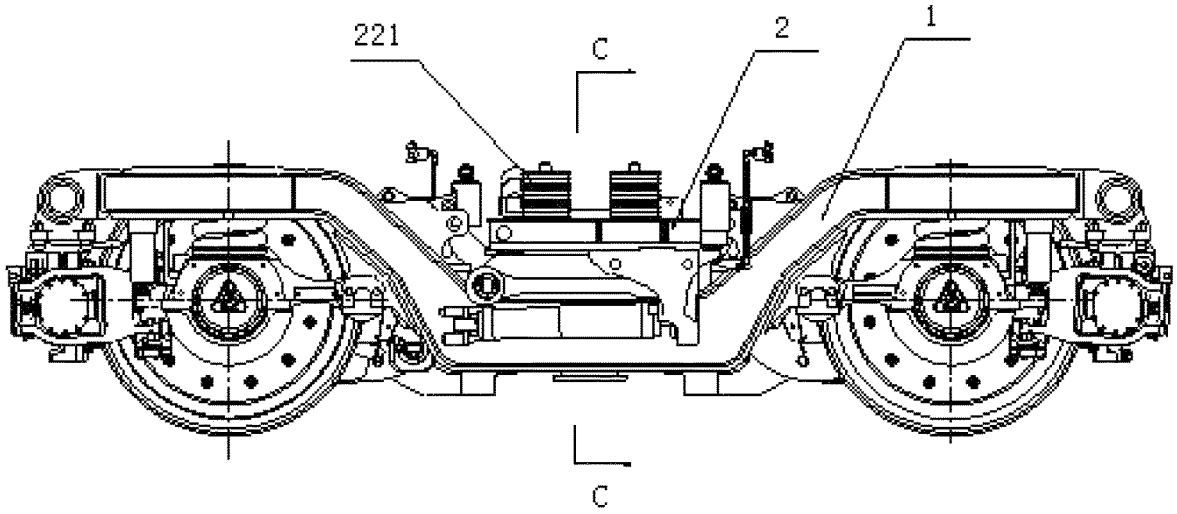
FIG. 18 is a primary view of FIG. 17 (viewed laterally from the propelling direction)
Figure 19:
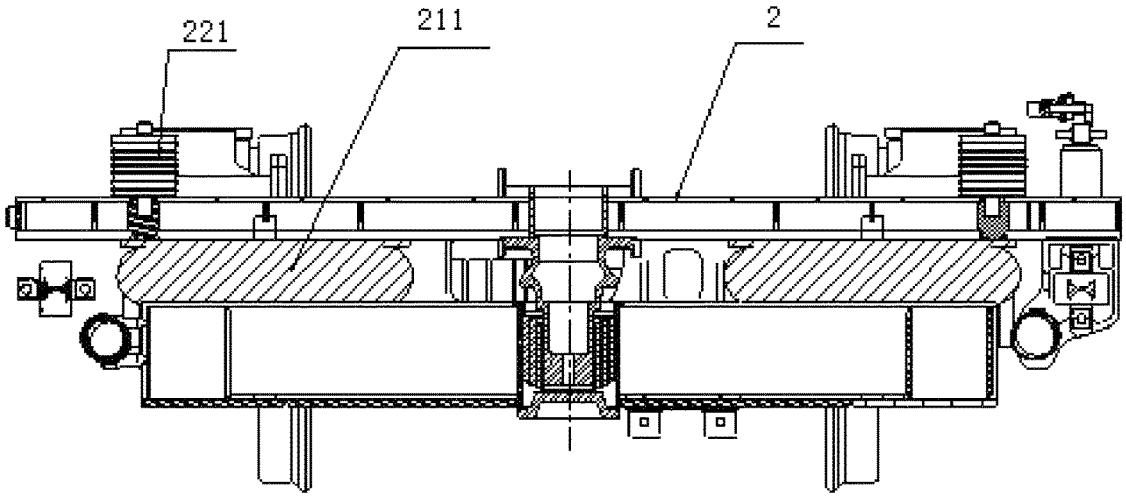
FIG. 19 is a cross-sectional view taken along the line C-C in FIG. 18.

FIG. 17 is a schematic perspective view of a bogie in Embodiment 4 of the present disclosure; FIG. 18 is a primary view of FIG. 17 (viewed laterally from the propelling direction);

and FIG. 19 is a cross-sectional view taken along the line C-C in FIG. 18.

Embodiment 4 is different from Embodiment 3 in that the secondary suspension is of a different structure. As shown in FIGS. 17 to 19, in Embodiment 4, the secondary suspension uses a second air spring 211 to replace the two parallel second spiral steel springs 351 shown in Embodiment 3. That is, in Embodiment 4, two second laminated rubber pads 221 are arranged in parallel above the left and right ends of the bolster 2, respectively. One second spiral steel springs 211 is arranged on the left and right ends below the bolster 2, respectively.

Embodiment 5

Figure 20:
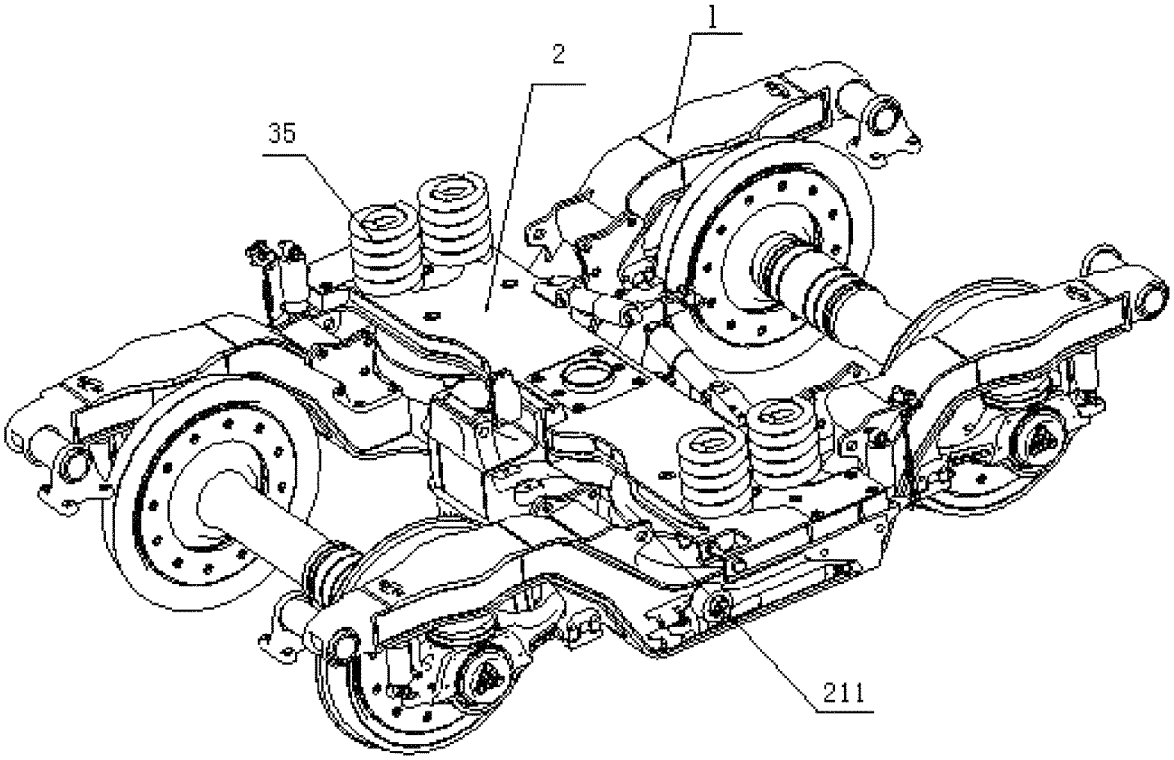
FIG. 20 is a schematic perspective view of a bogie in Embodiment 5 of the present disclosure.
Figure 21:
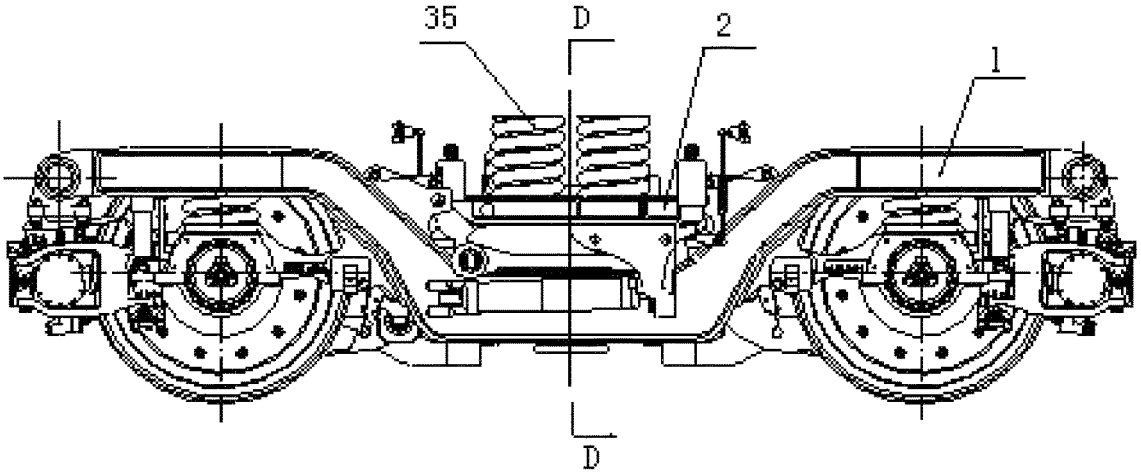
FIG. 21 is a primary view of FIG. 20 (viewed laterally from the propelling direction)
Figure 22:
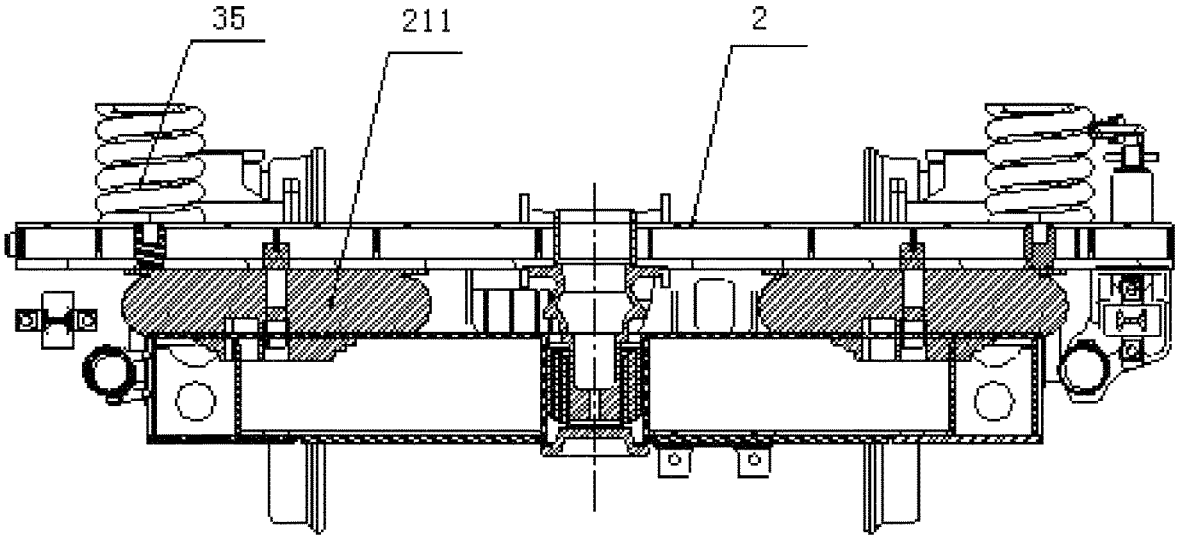
FIG. 22 is a cross-sectional view taken along the line D-D in FIG. 21.
Figure 23:
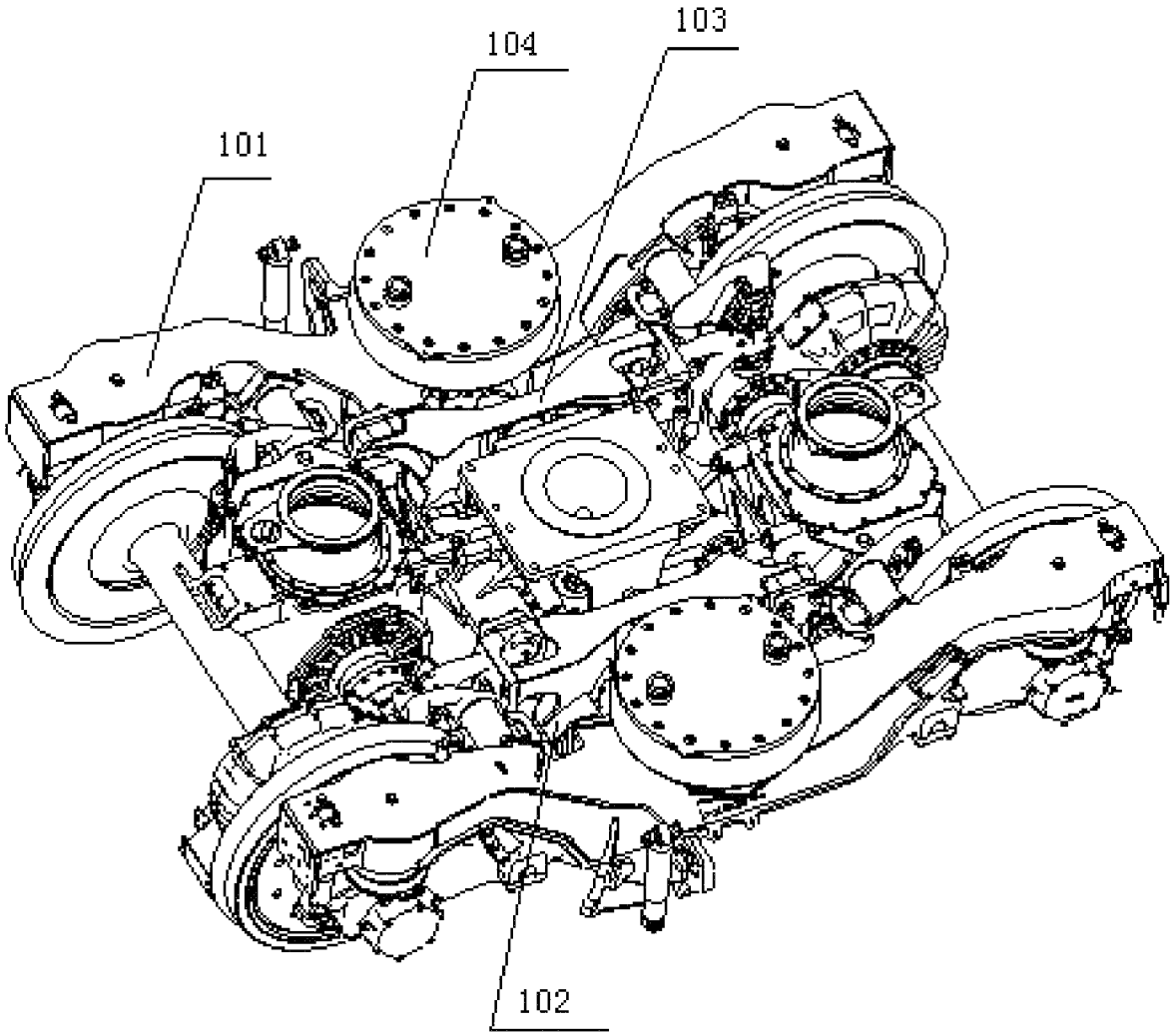
FIG. 23 is a schematic perspective structural view of a bogie in the prior art.

FIG. 20 is a schematic perspective view of a bogie in Embodiment 5 of the present disclosure; FIG. 21 is a primary view of FIG. 20 (viewed laterally from the propelling direction);

and FIG. 22 is a cross-sectional view taken along the line D-D in FIG. 21.

Embodiment 5 is different from Embodiment 2 in that the secondary suspension is of a different structure. As shown in FIGS. 20 to 21, in Embodiment 5, the secondary suspension uses a second air spring 211 to replace the two parallel second spiral steel springs 22 shown in Embodiment 32. That is, in Embodiment 5, two first spiral steel springs 35 are arranged in parallel above the left and right ends of the bolster 2, respectively. One second spiral steel springs 211 is arranged on the left and right ends below the bolster 2, respectively. It should be noted that in Embodiment 1 to 5 described above, the number, shape, and size of the amounting seat 122 for the secondary suspension on the upper surface of the cross beam 12 of the frame 1 are also matched with the different specific structures of the support component employed by the secondary suspension.

In summary, it can be seen from the description of the Embodiment 1 to 5 that the bogie of the present disclosure is provided with a bolster, and on the basis of the original two suspensions, another suspension is added beneath of the bolster and between the bolster and the cross beam to achieve the separation of the functions, so that the tertiary suspension only functions to handle the transverse displacement, and the secondary suspension only functions to handle the rotation, thereby further increasing, when the vehicle negotiates a curve, the relative rotation angle between the vehicle body and the bogie, improving curve negotiating for the vehicle. In addition, the combination of three suspensions can also perform well in vibration isolation and noise reduction, effectively attenuating the vibration from interactions between the wheel and the rail, improve riding comfort.

With respect to the terminologies in the claims and specific embodiments of the present application, the suspension structures used in the bogie are referred to in the order from bottom to top as the primary suspension, secondary suspension and tertiary suspension. In addition, in the terminologies "first laminated rubber pad", "first air spring", "first spiral steel spring", "second laminated rubber pad" and the like expressions, the "first", "second" only serves to distinguish between different components of the same kind.

In addition, the bogie were described in the Embodiment 1 to 5 above by way of example as an "H" frame for the sole purpose of illustrating a preferred solution. It should be understood by those skilled in the art that the frame 1 is not necessarily an "H" shape, but rather can also be in the shape of "III", "IIII", etc. As long as the structure of the cross beam including the two side beams and the middle portion of the side beam is satisfied, the purpose of the present disclosure can be fulfilled. In order to reduce the center of gravity of the whole and adapt to the need for stable operation of the high-speed vehicle, in the above described embodiments, the middle of the side beam is sunken into a sunken portion for receiving the bolster. In practice, in other applications, the side beam can be flat and straight, without the sunken middle, and still enable the three suspension structure, except that the center of gravity of the bolster and the vehicle body above it should be elevated.

Of course, the above described are merely preferred embodiments of the present disclosure, and it should be noted that, for those skilled in the art, improvements and refinements can still be made without departing from the principles of the present disclosure, and the improvements and refinements are also intended as part of the protection scope of the present disclosure.

What is claimed is:

1. A bogie, comprising a frame and a bolster, wherein the frame comprises two parallel side beams and a cross beam coupled to the middle of the side beams, a primary suspension is arranged between an end of the side beam and an axle box, a secondary suspension is arranged between the below of the bolster and the cross beam, and a tertiary suspension coupled to a vehicle body is arranged above the bolster, wherein a middle portion of the cross beam is provided with a traction pin hole, a middle portion of an underside of the bolster is provided with a traction pin, and the bolster is coupled to the cross beam through the traction pin, wherein the secondary suspension comprises four laminated rubber-metal pads, which are uniformly and symmetrically distributed between the below of the bolster and the cross beam.

2. The bogie according to claim 1, wherein the frame is formed as an "H".

3. The bogie according to claim 1, wherein a middle portion of the side beam is sunken to form a sunken portion for mounting the bolster.

4. The bogie according to claim 1, wherein the traction pin is provided with an elastic pin bush.

5. The bogie according to claim 4, wherein the elastic pin bush is a laminated rubber-metal structure.

6. The bogie according to claim 1, wherein the tertiary suspension comprises a plurality of laminated rubber pads, air springs or spiral steel springs, or any combination thereof.

7. The bogie according to claim 1, wherein the secondary suspension comprises a plurality of laminated rubber pads, air springs or spiral steel springs, or any combination thereof.

8. The bogie according to claim 1, wherein an upper surface of the cross beam is provided with a plurality of mounting seats for mounting the secondary suspension.

9. The bogie according to claim 1, wherein an upper surface of the cross beam is provided with four mounting seats for mounting the secondary suspension.

10. The bogie according to claim 1, wherein the traction pin hole is provided with an elastic bush.

11. The bogie according to claim 1, wherein a middle portion of one side of the bolster is provided with a transverse buffer.

12. The bogie according to claim 1, wherein another side of the bolster is provided with two transverse dampers opposed to each other, one end of the transverse damper is coupled to the bolster, and the other end is coupled to the bottom of the vehicle body.

13. The bogie according to claim 1, wherein both ends of the bolster are provided with two vertical dampers, respectively.

14. The bogie according to claim 1, wherein a center pin hole is provided at the middle of an upper side of the bolster for receiving a rigid stop pin arrange at the center of a bolster beam of the vehicle body.

15. The bogie according to claim 1, further comprising a "Z" traction rod, and a first mounting seat provided separately on both ends of the bolster, wherein a rubber joint is provided separately both ends of the traction rod, and one end of the traction rod is arranged on the first mounting seat while another end is coupled to the vehicle body.

16. The bogie according to claim 1, further comprising an anti-yaw damper, which is provided on one end at the first mounting seat of the end of the bolster, and coupled on another end to the side beam of the frame.

17. The bogie according to claim 1, further comprising a foundation brake apparatus which in turn comprises a tread brake unit and a disc brake unit, both ends of each of the side beams are provided with a disc brake mounting seat for mounting the disc brake unit, and the inner side of the sunken portion of each side beam is provided with a tread brake mounting seat for mounting the tread brake unite.

18. The bogie according to claim 1, wherein front and rear sides of the cross beam are provided with a motor hanger and a gear box hanger, which are both box structures formed by welding, forging or casting.

* * * * *